428-408 SR
5/21/85 XR 4,518,640

United States Patent [19]
Wilkens

[11] Patent Number: 4,518,640
[45] Date of Patent: May 21, 1985

[54] WARP KNITTED WARE WITH REINFORCING THREADS

[75] Inventor: Christian Wilkens, Heusenstamm, Fed. Rep. of Germany

[73] Assignee: Karl Mayer Textilmaschinenfabrik GmbH, Fed. Rep. of Germany

[21] Appl. No.: 578,355

[22] Filed: Feb. 8, 1984

[30] Foreign Application Priority Data

Feb. 9, 1983 [DE] Fed. Rep. of Germany ..... 3304345

[51] Int. Cl.[3] ..... B32B 3/06

[52] U.S. Cl. ..... 428/102; 66/192; 428/253; 428/254; 428/257; 428/408; 428/902

[58] Field of Search ..... 428/253, 254, 102, 257, 428/408, 902; 66/192, 193, 84 A

[56] References Cited

U.S. PATENT DOCUMENTS 2,890,579 6/1959 Mauersberger ..... 66/85 A
3,279,221 10/1966 Gliksmann ..... 66/192
3,672,187 6/1972 Simpson ..... 66/192
4,443,516 4/1984 Rogers ..... 418/254
4,444,822 4/1984 Doyle et al. ..... 428/254

*Primary Examiner*—James J. Bell
*Attorney, Agent, or Firm*—Omri M. Behr

[57] ABSTRACT

A warp knitted fabric employs a warp knitted pattern as the ground stitches. In this novel fabric there are reinforcing threads of a substantially rigid material. The weft threads may run parallel to each other and are located between the needle loops of stitch rows that follow each other sequentially in the warping direction. Additionally, there are two sets of diagonal threads both of which run alternatively: (a) between two needle loops of neighboring wales and (b) between two needle loops of successive stitch rows. Laid-in warp threads may be provided between needle loops of adjacent wales. There is thus provided a fabric having higher rigidity in all directions.

17 Claims, 4 Drawing Figures

WARP KNITTED WARE WITH REINFORCING THREADS

BACKGROUND OF THE INVENTION

1. Field of the Invention

The present invention relates to warp knitted ware utilizing tricot, chain or other stitches to form the ground fabric of the ware into which are laid reinforcing threads such as weft threads and various filler threads which are located in the vicinity of needle loops of adjacent chain stitches.

2. Discussion of the Relevant Art

As reinforcing threads, it is particularly desirable to utilize glass or carbon fibers which provide a substantial rigidity in the direction of thread extension. Such threads are somewhat inflexible and must therefore be utilized in a substantially linear fashion, that is to say they cannot be woven together as warps or wefts. These products are usually coated with a synthetic material so that they can be utilized as planes or as laminates for the formation of synthetic shaped bodies of high rigidity.

In a known type of warp knitted goods of the prior art [see Textiltechnik 31 (1981) p. 493] only chains and lightly crossing weft threads are utilized. This arrangement gives rise to an increased rigidity in the warp direction and in the weft direction but not in the diagonal direction. It should further be noted that the weft threads are partially penetrated by the needles of the needle bed which negatively affects the stability of the material.

It has further been disclosed (U.S. Pat. No. 3,819,461) that rigid threads may be used solely in the weft direction and be held together by chain stitches. This gives rise to higher stability in the weft direction than where the weft threads cross each other. In all other directions, however, the rigidity is not satisfactory.

It is further known (U.S. Pat. No. 2,890,579) to overlay a non-woven fabric with diagonal threads or warp inserts and to hold everything together by stitch sewing. In this material also, it should be noted that the crossing threads are penetrated by the needles of the needle bed which also negatively affects their strength.

Accordingly, there is a need for a warp knitted material which has equal rigidity in all directions in order to provide the highest total rigidity possible.

SUMMARY OF THE INVENTION

A fabric according to the principles of the present invention is enmeshed by stitched ground ware. The fabric has a plurality of parallel inlaid weft threads and a plurality of wales of warp thread stitched by rows. Each of the plurality of parallel inlaid weft threads are laidin across the wales and between two adjacent rows of stitch loops in the warp thread. The fabric also has a first and second plurality of diagonally inlaid threads. The first plurality crosses the second plurality. Each of the inlaid threads of the first and second plurality run alternatively and repetitively: (a) between two stitch loops of a corresponding adjacent pair of said wales and (b) between two stitch loops of two successive rows of stitch loops of the warp threads.

According to a related method of the same invention, fabric is formed from warp, weft and diagonal threads. The method includes the step of laying-in weft threads in a given series of transverse rows. Another step is laying-in diagonal thread in a first series of diagonal rows, each crossing the weft threads at an acute angle. The method also includes the step of laying-in diagonal thread in a second series of diagonal rows, each crossing the weft threads at an acute angle. The diagonal thread of the second series crosses that of the first series. Another step of the method is stitching the warp thread about the weft and diagonal threads to form a ground ware.

In one embodiment of the invention, the diagonal threads are provided between the planes of the weft inserted threads and the inlaid warp threads. This mode of operation makes it possible to provide both the weft threads and the diagonal threads on top of each other in a single weft thread magazine and to thus provide them to the needle bed.

In another embodiment the inlaid warp threads are provided between the diagonal threads and the weft threads. This has the advantage of providing goods having a lower longitudinally ribbed appearance upon which the coating material may be more readily laid.

BRIEF DESCRIPTION OF THE DRAWINGS

In order that the invention may be more fully understood, it will now be described, by way of example, with references to the accompanying drawings in which.

DESCRIPTION OF THE PREFERRED EMBODIMENTS

Figure 1:
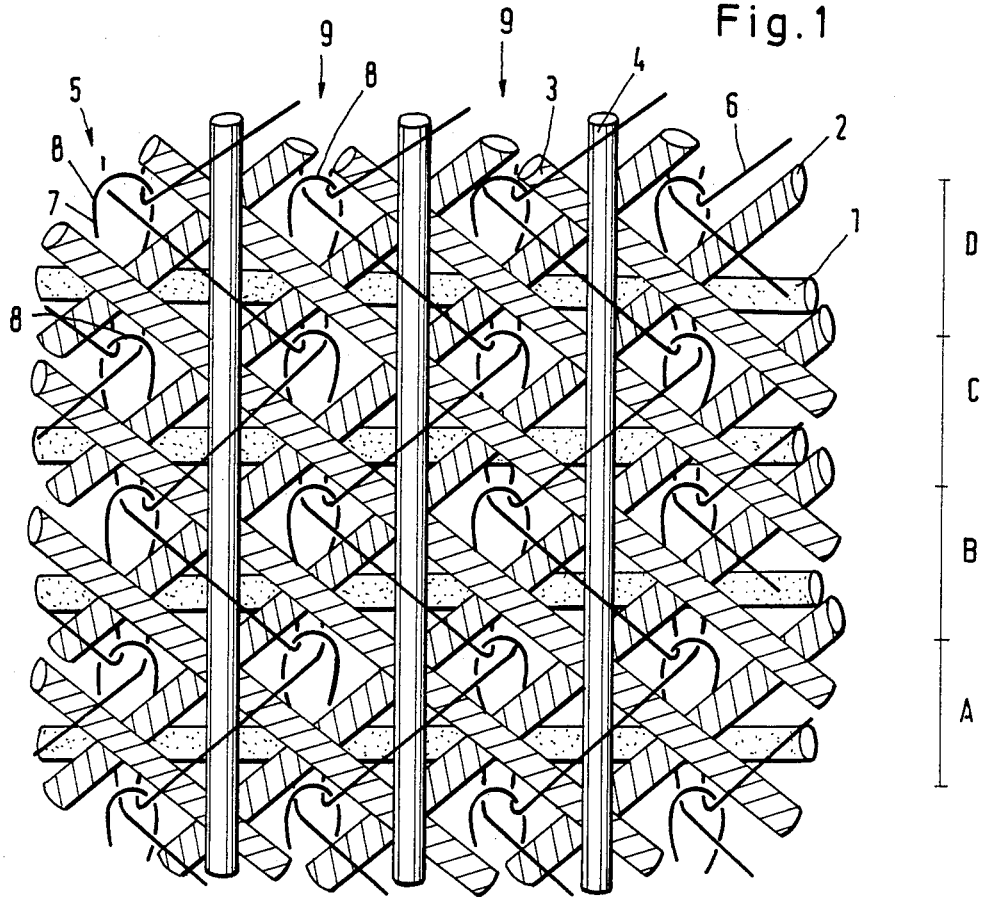
FIG. 1 is a schematic plan view of the fabric of the present invention.

The fabric of FIG. 1 is illustrated with four types of reinforcing threads of a substantially rigid material. Suitable fibers for this purpose are those of glass, carbon, high density polyester or combinations of the above (for example dtex 500 or higher values). These reinforcing threads comprise weft threads 1, a first plurality of diagonally inlaid threads 2, a second plurality of diagonally inlaid threads 3, and longitudinal (warp) inlaid threads 4. These reinforcing threads are bound into a knitted fabric 5, by means of one or more substantially thinner warp threads 6 (for example, dtex 76).

The warping system forms stitches 7 with needle loops 8. There are thus formed running wales 9 in the warp dirction and stitch rows A, B, C, D, etc. in the weft direction.

The weft threads 1 run parallel to each other and are located between the needle loops 8 of adjacent machine rows A, B, C, D, etc. Also the diagonal threads 2 and 3 lie mutually parallel within their respective series and they run in alternating fashion between two needle loops 8 of neighboring wales 9 and between two needle loops 8 in sequentially following stitch row A, B, C and D in the warp direction. The inlaid threads 4 are similarly provided in a mutually parallel manner and are located between the needle loops 8 of neighboring wales 9. In this manner, the needles of the needle beds can always pass through the interstices of the reinforcing threads. The inlaid weft thread 1 and the diagonal threads 2 and 3 are provided in a conventional manner, for example, by means of known magazine arrangement for weft threads and diagonal threads.

For example, the weft thread magazine of the knitting machine of U.S. Pat. No. 4,395,888 can lay-in threads in a weft or diagonal direction. Moreover, inserts are provided from a warp beam in the conventional manner. See for example, D. F. Palieng, Warp Kniitting Technology, Columbine Press, Buxton, Derbyshire, U.K. (1970). Such knitting equipment operates to lay-in warp thread 4 through ordinary thread guides.

Thus, thread magazines as shown in U.S. Pat. No. 4,395,888 place the reinforcing threads on carrying chains in the weft direction in addition to the diagonal direction. These reinforcing threads are oriented and their delivery to the needle bed (see above patent) timed in such a manner that they are not penetrated by the needles of the needle bed. This is possible because these reinforcing threads are provided in a manner directly dependent upon the stitch formation cycle of the above knitting machine. The above machine is so configured to provide the reinforcing threads in parallel rows. In the optimal embodiment the inlaid warp and weft threads subtend an angle of 90 degrees to each other and the diagonal threads subtend an angle of 45 degrees to both the weft and the warp inserted threads 1, 4. Such an orientation provides the highest possible rigidity in the longitudinal, transverse and diagonal directions of the ware. Since the needles (not shown) can always run between the individual reinforcing threads, the knitting cycle may proceed very readily. The ground fabric of the goods can thus be made of very thin warp threads which are sufficient to hold the reinforcing threads together until a subsequent coating stage in their ultimate use.

Thus, there are provided a plurality of weft threads 1 running parallel to each other and which are located between the needle loops 8 of stitch rows A, B, C, D running in the warping direction, and additionally comprising two sets of diagonal threads 2, 3 which run alternately between two needle loops 8 in successive stitch rows A, B, C, D in the warping direction.

Figure 2:
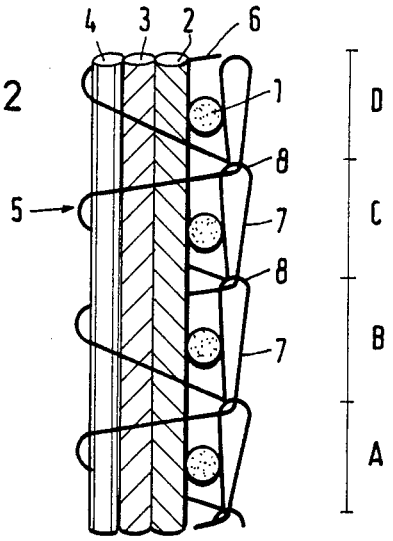
FIG. 2 is a cross-sectional view of the fabric of FIG. 1.
Figure 3:
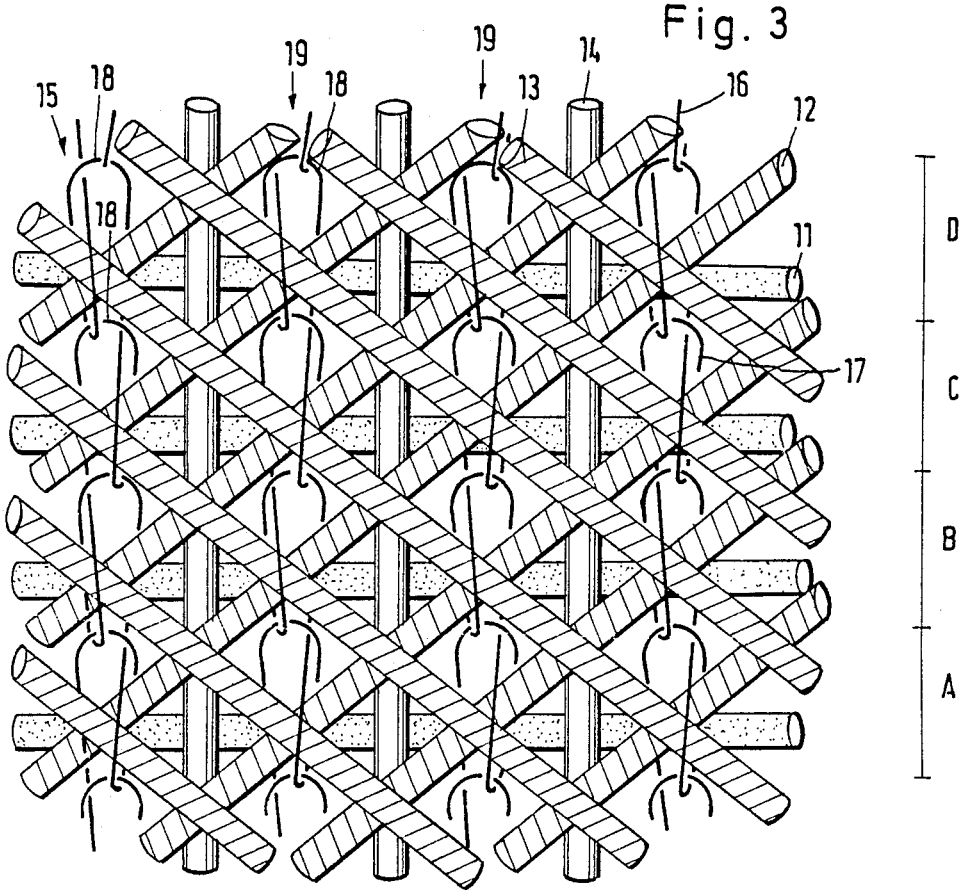
FIG. 3 is a schematic plan view of an alternate embodiment of the fabric of the present invention.
Figure 4:
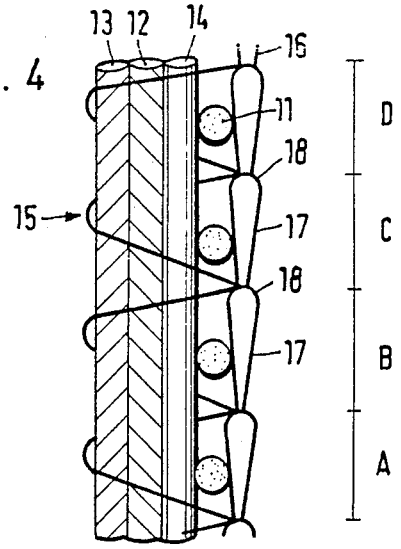
FIG. 4 is a cross-sectional view of the goods of FIG. 3.

In the embodiment of FIGS. 3 and 4 the corresponding parts are illustrated by part numbers incremented by ten. This particular embodiment may be differentiated from that of FIGS. 1 and 2 in that the stitch pattern is not tricot but rather chain stitch. Furthermore, it will be noted that the warp inserts 14 are located between the weft threads 11 and the diagonal threads 12 and 13.

The ground ware is thus constructed in a very simple manner, and may comprise solely chain stitches. Such chain stitches contribute to the longitudinal stability with a minimum thread consumption for each stitch row. However, other stitches such as the 2-0-4-6 stitch, the Atlas stitch or the Koeper (two needle overlap) stitch are equally utilizable.

It will be clear to those skilled in the art that other combinations of orientation of the reinforcing threads in relationship to each other are possible and are to be considered as included within the scope of the present invention.

The terms "weft", "diagonal" and "warp" threads include not only single filaments but also groups of single filaments or thread combinations which run between the needle loops in the above described manner.

If advantagous in the ultimate use of the material thus produced, it is also considered to be in the scope of the present invention to omit certain of the reinforcing threads; for example, to insert only every second possible weft thread; and/or diagonal thread; and/or inlaid warp thread. Also, if the ultimate material is intended to have a ribbed appearance, certain of the warp insert threads may be omitted.

It will be understood that various other changes in the details, materials, arrangement of parts and operating conditions which have been herein described and illustrated in order to explain the nature of the invention may be made by those skilled in the art within the principles and scope of instant invention.

What is claimed is:

1. A fabric enmeshed by stitched ground ware, comprising:

a plurality of wales of warp thread stitched by rows;

a plurality of parallel, inlaid weft threads, each laid-in across said wales and between two adjacent rows of stitch loops in said warp thread, said rows of stitch loops being transverse to said warp thread; and a first and second plurality of diagonally inlaid threads, said first plurality crossing said second plurality, each of the inlaid threads of said first and second plurality running alternatively and repetitively: (a) between two stitch loops of a corresponding adjacent pair of said wales and (b) between two stitch loops of two successive rows of stitch loops of said warp threads.

2. A fabric according to claim 1 further comprising:

a plurality of inlaid longitudinal threads, each laid-in between stitch loops of a corresponding adjacent pair of wales.

3. A fabric according to claim 2 wherein said first and second plurality of diagonally inlaid threads are sandwiched between said weft threads and said longitudinal threads.

4. A fabric according to claim 2 wherein said longitudinal threads are sandwiched between said weft threads and said diagonally inlaid threads.

5. A fabric according to claim 2 wherein said wales of warp thread are formed into a plurality of chain stitches.

6. A fabric according to claim 2 wherein said wales of warp thread are formed into a plurality of tricot stitches.

7. A fabric according to claim 1 wherein said weft threads and said diagonally inlaid threads are positioned to leave openings that allow stitching of said warp threads without piercing of said weft thread or said diagonally inlaid thread.

8. A fabric according to claim 7 wherein said weft threads and said diagonally inlaid threads are substantially thicker and stronger than said warp threads.

9. A fabric according to claim 8 wherein said fabric is coated with a synthetic material to form a laminated structure.

10. A method for forming a fabric with warp thread, weft thread and diagonal thread, comprising the steps of:

laying-in said weft threads in a given series of transverse rows;

laying-in said diagonal thread in a first series of diagonal rows, each crossing said weft threads at an acute angle;

laying-in said diagonal thread in a second series of diagonal rows, each crossing said weft threads at an acute angle, the diagonal thread of said second series crossing that of said first series; and stitching said warp thread about said weft and diagonal threads to form a ground ware, said stitching forming spaced stitch loops between the diagonal thread of both said first and second series.

11. A method according to claim 10 employing longitudinal thread and further comprising the step of:

laying-in said longitudinal thread in a predetermined series of longitudinal rows, the step of stitching said warp threads being performed about said longitudinal thread.

12. A method according to claim 11 wherein said diagonal threads are sandwiched between said weft threads and said longitudinal threads.

13. A method according to claim 11 wherein said longitudinal threads are sandwiched between said weft threads and said diagonal threads.

14. A method according to claim 11 wherein the step of stitching said warp thread is conducted so as to form chain stitches.

15. A method according to claim 11 wherein the step of stitching said warp thread is conducted so as to form tricot stitches.

16. A method according to claim 10 wherein the step of stitching said warp threads is conducted without piercing said weft thread or said diagonal thread.

17. A method according to claim 16 further including the step of:

coating the warp, diagonal and weft threads with a synthetic material to form a laminate.

* * * * *